US009429345B2

(12) United States Patent
Kopko et al.

(10) Patent No.: US 9,429,345 B2
(45) **Date of Patent: *Aug. 30, 2016**

(54) HEAT-PUMP CHILLER WITH IMPROVED HEAT RECOVERY FEATURES

(71) Applicant: Johnson Controls Technology Company, Holland, MI (US)

(72) Inventors: William L. Kopko, Jacobus, PA (US); Ian Michael Casper, York, PA (US); Douglas Alan Kester, York, PA (US); Satheesh Kulankara, York, PA (US)

(73) Assignee: Johnson Controls Technology Company, Holland, MI (US)

( * ) Notice: Subject to any disclaimer, the term of this patent is extended or adjusted under 35 U.S.C. 154(b) by 167 days.

This patent is subject to a terminal disclaimer.

(21) Appl. No.: 14/026,574

(22) Filed: Sep. 13, 2013

(65) Prior Publication Data

US 2014/0013788 A1 Jan. 16, 2014

Related U.S. Application Data

(63) Continuation of application No. 12/855,281, filed on Aug. 12, 2010, now Pat. No. 8,539,789.

(60) Provisional application No. 61/234,457, filed on Aug. 17, 2009.

(51) Int. Cl.
*F25B 30/02* (2006.01)
*F25B 29/00* (2006.01)
(Continued)

(52) U.S. Cl.
CPC ..... *F25B 30/02* (2013.01); *F25B 29/003* (2013.01); *F25B 5/04* (2013.01); *F25B 6/04* (2013.01);
(Continued)

(58) Field of Classification Search
CPC .. F25B 30/02; F25B 5/04; F25B 2341/0662; F25B 2700/1933; F25B 2700/2103; F25B 2700/21151; F25B 2700/21172; F25B 6/04; F25B 20/003; F25B 2339/047; F25B 2700/1931; F25B 2700/195; F25B 2700/2106; F25B 2700/21161; F25B 2700/21173
USPC ..... 62/324.5, 498, 324.6, 278, 513, 173; 165/62, 103
See application file for complete search history.

(56) References Cited

U.S. PATENT DOCUMENTS 4,621,501 A 11/1986 Tanaka
5,174,123 A * 12/1992 Erickson ..... 62/113
(Continued)

FOREIGN PATENT DOCUMENTS

EP 1348920 1/2003
EP 1391664 2/2004
(Continued)

*Primary Examiner* — Mohammad M Ali
(74) *Attorney, Agent, or Firm* — Fletcher Yoder, P.C.

(57) ABSTRACT

A heating and cooling system includes an evaporator, a compressor, and a condenser. A heat exchanger, which may be an outdoor heat exchanger, is configured to receive the refrigerant from the condenser, to selectively extract heat from or to add heat to the refrigerant, and to transfer the refrigerant to the evaporator. First control valving, disposed between the condenser and the heat exchanger, is configured to regulate flow of the refrigerant from the condenser to the heat exchanger in a first mode of operation. Second control valving, disposed between the condenser and the heat exchanger, is configured to regulate flow of the refrigerant from the heat exchanger to the evaporator in a second mode of operation. The system may be operated in a variety of modes by appropriate control of the valving and other system components.

20 Claims, 4 Drawing Sheets

(51) Int. Cl.
*F25B 5/04* (2006.01)
*F25B 6/04* (2006.01)

(52) U.S. Cl.
CPC .. *F25B 2339/047* (2013.01); *F25B 2341/0662* (2013.01); *F25B 2700/195* (2013.01); *F25B 2700/1931* (2013.01); *F25B 2700/1933* (2013.01); *F25B 2700/2103* (2013.01); *F25B 2700/2106* (2013.01); *F25B 2700/21151* (2013.01); *F25B 2700/21161* (2013.01); *F25B 2700/21172* (2013.01); *F25B 2700/21173* (2013.01)

(56) References Cited

U.S. PATENT DOCUMENTS 5,711,163 A 1/1998 Uchikawa et al.
5,720,178 A * 2/1998 Silvetti ..... F25B 41/04 62/117
5,848,537 A 12/1998 Biancardi et al.
6,604,376 B1 8/2003 Demarco et al.
6,655,164 B2 * 12/2003 Rogstam ..... 62/238.7
6,668,569 B1 12/2003 Jin
6,826,921 B1 12/2004 Uselton
6,964,178 B2 11/2005 Aikawa et al.
7,275,387 B2 10/2007 Gist et al.
7,491,037 B2 * 2/2009 Edwards ..... F01C 21/0836 417/315
7,647,774 B2 1/2010 Shirk et al.
2002/0184908 A1 * 12/2002 Brotz et al. ..... 62/259.2
2005/0167516 A1 * 8/2005 Saitoh et al. ..... 237/2 B
2006/0196225 A1 * 9/2006 Han ..... 62/513

FOREIGN PATENT DOCUMENTS

EP 1379817 10/2004
EP 1491608 12/2004
JP 2003287294 10/2003
WO 2008045039 4/2008
WO 2008045040 4/2008

* cited by examiner

| MODE | OUTDOOR COIL AND CONTROL VALVES | OUTDOOR FAN | COMPRESSOR CAPACITY | EVAPORATOR PUMP | CONDENSER PUMP |
|---|---|---|---|---|---|
| 1) COOLING ONLY | CONDENSER MODE | CONTROL ON CONDENSER PRESSURE | LEAVING CHILLED LIQUID TEMPERATURE | ON | OFF |
| 2) COOLING WITH PARTIAL HEAT RECOVERY | CONDENSER MODE | CONTROLLED ON CONDENSER PRESSURE | LEAVING CHILLED LIQUID TEMPERATURE | ON | ON |
| 3) WATER-TO-WATER HEAT PUMP WITH SUPPLEMENTAL OUTDOOR HEAT REJECTION | CONDENSER MODE | CONTROL ON CONDENSER LEAVING WATER TEMPERATURE | LEAVING CHILLED LIQUID TEMPERATURE | ON | ON |
| 4) WATER-TO-WATER HEAT PUMP WITH ~100% HEAT RECOVERY | CONTROLS OPERATE VALVES TOGETHER TO MAINTAIN TWO-PHASE FLOW IN OUTDOOR COIL WITH REFRIGERANT NEAR AMBIENT AIR TEMPERATURE | FAN OFF | LEAVING CHILLED LIQUID TEMPERATURE | ON | ON |
| 5) WATER-TO-WATER HEAT PUMP WITH SUPPLEMENTAL OUTDOOR HEAT SOURCE | EVAPORATOR MODE, SUCTION SUPERHEAT MODULATED TO MAINTAIN LEAVING CHILLED WATER TEMPERATURE | CONTROL ON EVAPORATOR PRESSURE AND /OR AMBIENT TEMPERATURE | LEAVING CONDENSER LIQUID TEMPERATURE | ON | ON |
| 6) AIR-TO-WATER HEAT PUMP | EVAPORATOR MODE WITH VALVE 1 CONTROL BASED ON SUCTION SUPERHEAT | EVAPORATOR PRESSURE OR COMPRESSOR CAPACITY | LEAVING CONDENSER LIQUID TEMPERATURE | OFF. NEEDS BRINE FOR FREEZE PROTECTION | ON |
| 7) DEFROST | CONDENSER MODE | FAN OFF | HIGH CAPACITY | ON | FLOW NOT REQUIRED |

FIG. 2

HEAT-PUMP CHILLER WITH IMPROVED HEAT RECOVERY FEATURES

CROSS REFERENCE TO RELATED APPLICATIONS

This application is a continuation of prior application Ser. No. 12/855,281, filed Aug. 12, 2010, entitled "HEAT-PUMP CHILLER WITH IMPROVED HEAT RECOVERY FEATURES", which claims priority from and the benefit of U.S. Provisional Application Ser. No. 61/234,457, entitled "HEAT-PUMP CHILLER WITH IMPROVED HEAT RECOVERY FEATURES", filed Aug. 17, 2009, which are hereby incorporated by reference.

BACKGROUND

The invention relates generally to the field of heating, ventilating, air conditioning, and refrigeration (HVAC&R) systems, and particularly to systems that can perform heating and cooling functions, such as with chilled water.

A range of systems are known and presently in use for heating and cooling of fluids such as water, brine, air, and so forth. In many building HVAC&R systems, for example, water or brine is heated or cooled and then circulated through the building where it is channeled through air handlers that blow air through heat exchangers to heat or cool the air, depending upon the season and building conditions. Some such systems are designed and used for cooling only, while others may function as a heat pump. In heat pump systems, the direction of refrigerant flow through refrigerant evaporating and condensing heat exchangers is reversed to allow for extraction of heat from a controlled space (cooling mode), or for the injection of heat into the space (heat pump mode).

Existing technologies for heat pump and heat recovery for chilled water systems include several that each benefit from certain advantages, but that also suffer from drawbacks. For example, water-to-water heat pumps generally have good efficiency, and good control over hot water temperatures in heat pump mode. Such systems are generally available, but normally require simultaneous heating and cooling loads for proper operation. They may be prone to fouling if used with wet tower evaporators when used in cooling operation only. Air-cooled chillers with heat recovery are also available, and have the benefits of being inexpensive and efficient at high ambient temperatures. However, such systems have limited control over water temperatures and available heating capacity, particularly at lower ambient temperatures. Air-to-water heat pumps, typically more readily available in Europe and Asia, and less so in North America, offer efficient heating and good control over water temperatures. However, such systems are expensive and do not provide heating and cooling in a single unit. Moreover, pressure drops through a reversing valve used to switch between cooling and heat pump modes are typically very high.

Other heat-pump technologies are available for direct expansion ("DX") systems where refrigerant directly heats or cools indoor air, but there are issues that limit their application. Air-to-air heat pumps, geothermal heat pumps, and variable refrigerant flow ("VRF") systems are examples of DX systems. They have obvious limitations for retrofitting to existing buildings with chilled water systems. They are generally useful in smaller buildings or single-story buildings. The sizes of individual systems are small, typically less than 20 tons, so large buildings would require many systems with long runs of refrigerant piping.

An additional issue with these systems is that they can allow refrigerant to leak directly into occupied space, which can create environmental concerns, especially for natural refrigerants. While such concerns exist with current refrigerants, they are clearly more poignant when employing refrigerants with increased flammability and/or toxicity, such as hydrocarbons, ammonia, and HFO-1234yf.

There is a need for improved HVAC&R systems capable of offering both heating and cooling of secondary fluids, such as water or brine.

SUMMARY

The present invention relates to systems and methods designed to respond to such needs. The systems may be designed generally for many HVAC&R applications, and are particularly well suited for cooling and/or heating of secondary fluids such as water and brine. A typical system in accordance with the invention may include an evaporator configured to vaporize a refrigerant to cool a first fluid stream, a compressor coupled to the evaporator and configured to compress the vaporized refrigerant, and a condenser configured to condense the refrigerant compressed by the compressor to heat a second fluid stream. Another heat exchanger, which may be positioned outside of a controlled space, such as a building, is configured to receive the refrigerant from the condenser, to selectively extract heat from or to add heat to the refrigerant, and to transfer the refrigerant to the evaporator. First control valving is coupled between the condenser and the heat exchanger, and configured to regulate flow of the refrigerant from the condenser to the heat exchanger in a first mode of operation of the system. Second control valving is coupled between the condenser and the heat exchanger, and configured to regulate flow of the refrigerant from the heat exchanger to the evaporator in a second mode of operation of the system.

Depending upon the application and its needs, a number of different operating modes may be implemented by proper control of the valving. For example, the system may operate in two or more of the following modes: a cooling only mode, a cooling mode with partial heat recovery, a heat pump mode with supplemental heat rejection, a heat pump mode with full heat recovery, a heat pump mode with supplemental heat sourced from the heat exchanger, a heat only mode, and a defrost mode.

DRAWINGS

FIG. 2 is a table illustrating various presently contemplated modes of operation of the system of FIG. 1, and how certain components may be controlled in the various modes;

DETAILED DESCRIPTION

Figure 1:
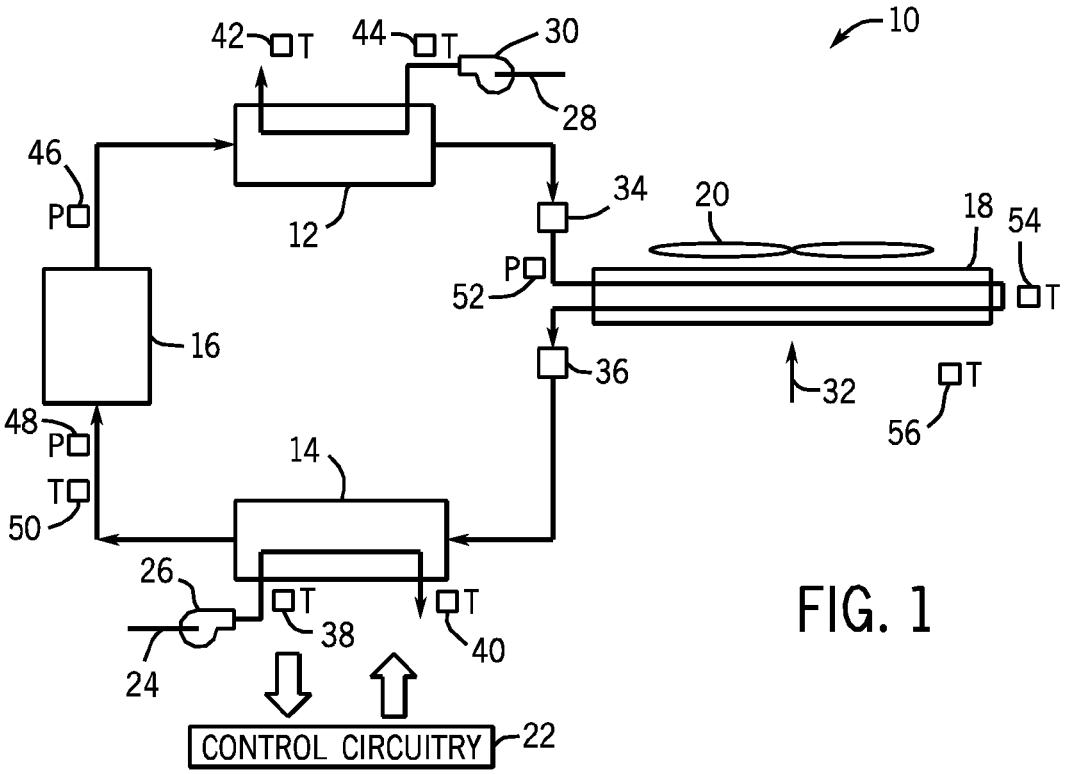
FIG. 1 is diagrammatical view of an exemplary HVAC&R system in accordance with aspects of the present invention.

Turning to the drawings, FIG. 1 illustrates an exemplary HVAC&R system 10 in accordance with aspects of the present techniques. The illustrated system includes a condenser 12 that condenses circulating refrigerant (or more generally, a first process fluid), and an evaporator 14 that vaporizes the refrigerant. A compressor 16 compresses the vaporized refrigerant for return to the condenser. A further heat exchanger 18 is coupled between the condenser and the evaporator, and receives the circulating refrigerant, and may either extract heat from the fluid, inject heat into the fluid, or serve as a conduit for the refrigerant with little heat transfer depending upon the mode of operation.

In certain applications, the heat exchanger 18 will be positioned outside of a temperature and/or humidity-controlled volume, such as outside of a building. In such cases, it may be referred to as an outside heat exchanger, although the physical placement of all three heat exchangers may depend upon the particular application and installation. For example, a preferred configuration is to have the entire refrigerant circuit and controls placed outside with a structure and a general layout similar to modified air-cooled scroll or screw chillers, such as the Johnson Controls YCAL, YLAA, and YCIV model lines. This configuration has the advantages of minimizing field refrigerant piping and minimizing space requirements inside the building. Alternatively, only heat exchanger 18 and fan 20 may be outside, and the rest of the system may be inside the building with a general structure similar to water-cooled scroll or screw chillers, such as the Johnson Controls YCWL or YCWS model lines.

In the illustrated embodiment, a fan 20 forces air over coils of heat exchanger 18. In practice, various types of heat exchangers may be used for the condenser 12, the evaporator 14, and the heat exchanger 18. These include conventional fin and tube designs, microchannel designs, falling film evaporators, and more generally, designs in which the refrigerant circulates within heat exchanger tubes ("tube-side") and designs in which refrigerant circulates outside of tubes, typically within a shell ("shell-side").

The system operates under the control of control circuitry, indicated generally by reference numeral 22. This circuitry will typically include one or more processors with supporting memory circuitry and/or firmware that stores routines carried out by the processor, as described below. The processor may be of any suitable type, including microprocessors, field programmable gate arrays, processors of special purpose and general purpose computers, and so forth. Similarly, memory might include random access memory, flash memory, read only memory, or any other suitable type. Although not separately represented, the circuitry will also include or be associated with input/output circuitry for receiving sensed signals, and interface circuitry for outputting control signals for the valving, motors, and so forth, as discussed below.

The system illustrated in FIG. 1 may be implemented to serve a range of purposes and to implement various operational modes. As illustrated, for example, evaporator 14 receives a secondary fluid stream 24 that is pumped through the evaporator by a pump 26. Similarly, another fluid stream 28, which may in some cases the same secondary fluid, is circulated through the condenser by means of a pump 30. As will be appreciated by those skilled in this art, the secondary fluids may be further circulated through a range of other equipment for heating and cooling purposes. For example, in a typical building HVAC&R application, the secondary fluids may be water or brine that is circulated through building conduits and thereby through air handlers through which building air blows to raise and/or lower its temperature. Many other and particular applications may be made of the secondary fluid.

As also illustrated in FIG. 1, fluid control valving 34 is disposed in the refrigerant path between the condenser 12 and the heat exchanger 18, while fluid control valving 36 is disposed in the path between the heat exchanger 18 and the evaporator 14. In one implementation, the valving may comprise actuator-operated two-way valves, such as ball valves that can be opened and closed under the control of the control circuitry 22 to provide a relatively high pressure drop in the fluid (acting as an expansion device), or very little pressure drop (essentially an open conduit). As described below, regulation of the opening and closing of this valving can permit the system to operate in various modes, and force the heat exchanger 18 to function as an evaporator or as a condenser, depending on position of the control valving. For operation of the coil of the heat exchanger as an evaporator, the first control valving 34 is mostly closed to act as an expansion device, and the second control valve is wide open. To use the coil of heat exchanger 18 as a condenser, the operation of the control valving is reversed. The second control valving 36 is modulated to act as an expansion valve, while the first control valving 34 is wide open. This mode of operation effectively moves the heat exchanger to the low side of the refrigerant circuit.

It should be noted that in the embodiments and modes described below, the control circuitry may have access to signals indicating the operating state of the various components of the system, and/or may control such components directly. For example, in addition to controlling valving 34 and 36, the circuitry may control motors associated with fan 20, as well as motors associated with the compressor 16 and pumps 26 and 30. As will be appreciated by those skilled in the art, the system may include a wide array of controllable or detectable parameters, including valving or control devices associated with the compressor 16, and with the secondary fluid systems.

In addition, the system may include instrumentation that serves to provide signals that may be used as a basis for monitoring and/or control. In the illustrated embodiment, for example, a temperature sensor 38 may detect the incoming temperature of the secondary fluid stream 24 through the evaporator 14, and a similar sensor 40 may detect the outgoing stream temperature. Similarly, sensors 42 and 44 may detect the temperatures of the secondary fluid stream 28 on both sides of the condenser 12. A pressure transducer 46 may detect the discharge pressure of the refrigerant exiting the compressor 16, while another transducer 48 may detect the inlet pressure. For certain purposes, such as the calculation of superheat of the refrigerant upstream of the compressor 16, a temperature sensor 50 may be provided. Similarly, a pressure transducer 52 may detect the pressure of the refrigerant in the heat exchanger 18, while a temperature sensor 54 may detect its temperature. Another temperature sensor 56 may detect ambient temperature (e.g., of the air surrounding and circulating through the heat exchanger). It should be noted that all of the instrumentation may provide signals to the control circuitry 22, which can manipulate, scale, and process the signals, and make calculations and control decisions based upon these inputs. It should also be noted that in many applications, the control circuitry may receive a range of other inputs, such as for temperatures, pressures, flow rates, and so forth from the secondary fluid circulating systems.

FIG. 2 is a table listing certain presently contemplated modes of operation of the inventive system, implemented by appropriate control of the system components, particularly the valving that circulates refrigerant into and out of the heat exchanger between the condenser and evaporator. Seven exemplary modes of operation are listed, including:

1. Cooling only: The (outdoor) heat exchanger 18 operates as a condenser with no secondary (e.g., water or brine) flow through the condenser. The compressor capacity may be controlled based on the temperature of the leaving chilled fluid stream 24 (e.g., brine). Operation of the fan 20 may be controlled to minimize energy use while maintaining an adequate pressure difference for flow through control valving 36.
2. Cooling with partial heat recovery: Same as the cooling only mode, but with secondary fluid circulating through the condenser. This may include no control of hot-water temperature.
3. Water-to-water heat pump with supplemental heat rejection: Same as the cooling with partial heat recovery mode, except that the operation (capacity) of the fan 20 is modulated to maintain a constant leaving hot secondary fluid (e.g., water) temperature from the condenser.
4. Water-to-water heat pump with full heat recovery: Same as the cooling with partial heat recovery mode, but with control of the refrigerant pressure in the ("outdoor") heat exchanger 18. This may serve to minimize heat transfer to or from the heat exchanger 18 while maintaining two-phase flow through the heat exchanger. The position of control valving 34 would be controlled to maintain a heat exchanger refrigerant temperature near the ambient air temperature. The position of control valving 36 maintains a constant superheat from the evaporator. (While superheat control is preferred for in-tube evaporation, control based on evaporator liquid-level or even fixed orifice setting are preferred for shell-side evaporation in evaporator 14.) This approach prevents the heat exchanger 18 from filling with refrigerant liquid, which can result in low suction pressure and other operational problems.
5. Water-to-water heat pump with supplemental ("outdoor") heat source heat exchanger: Same as the heating only mode discussed below, except with secondary fluid (e.g., brine) flow through the evaporator. This could be accompanied by control of the valving and/or secondary fluid flow control cooling capacity from the evaporator.
6. Heating only (air-to-water heat pump): The heat exchanger 18 is operated as an evaporator. The fan 20 normally operates at full speed with no secondary fluid flow through the evaporator. Compressor capacity is based on the temperature of the secondary fluid stream 28 (e.g., hot water). Note that this mode may expose the liquid side of the evaporator to subfreezing temperatures, so it may be preferred to use glycol solutions or other antifreeze solutions if this mode of operation is required. If this mode of operation is not required, it may be possible to use water if proper controls are included to protect against freezing conditions.
7. Defrost: The heat exchanger 18 operates as a condenser with fan 20 off. Secondary fluid (e.g., brine) is circulated through the evaporator. This mode heats the coil of the heat exchanger 18 to melt any accumulation of ice and frost.

A possible type of valve for use as control valving 34 and 36 in FIG. 1 is a motor-actuated ball valve. The valving would be large enough provide an acceptably low pressure drop with refrigerant flow in vapor phase. At the same time, the valving would be able maintain good control as an expansion valve at low refrigerant flow conditions.

Figure 3:
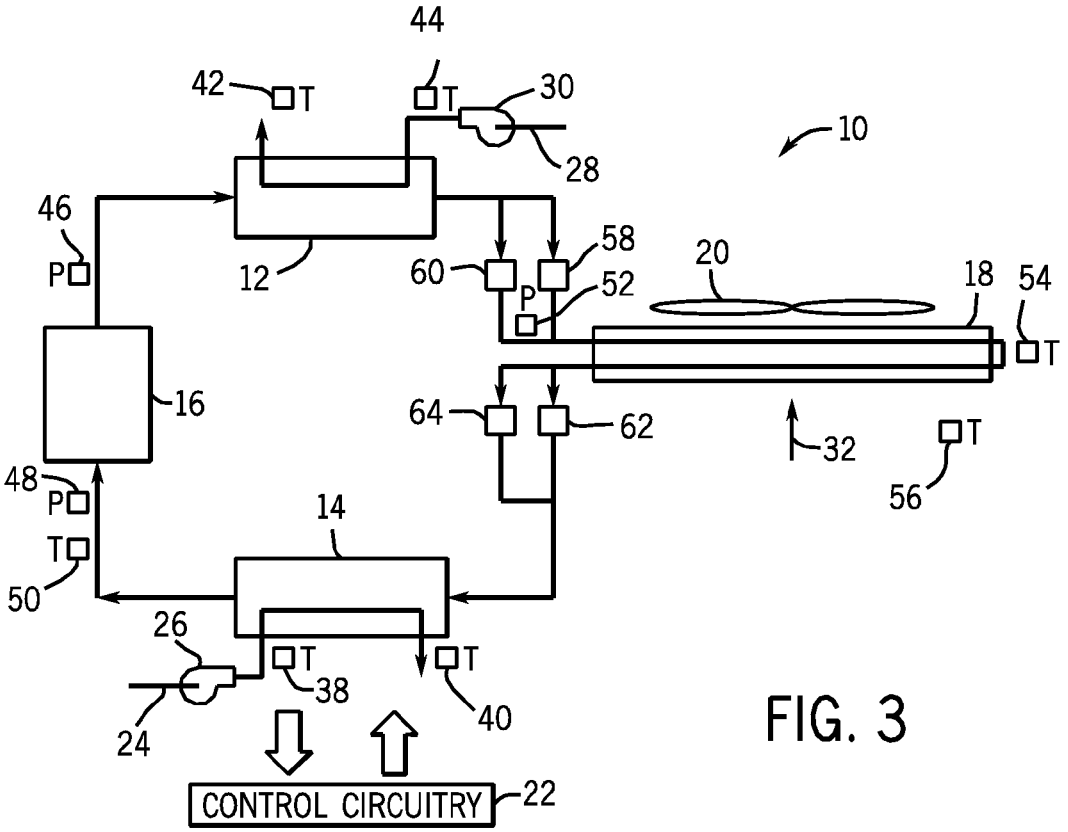
FIG. 3 is a diagrammatical view of an alternative configuration of the inventive system.

Another alternative for handling the functions of the control valving is shown in FIG. 3. In the illustrated alternative, a bypass valve 58 is coupled in the refrigerant path in parallel with an expansion valve 60, such as an electronic expansion valve. The bypass valve 58 may be a motor-actuated ball valve. Another option is a solenoid valve or other valve that is a capable of handling a large flow of refrigerant vapor with minimal pressure drop. A similar arrangement is provided in the refrigerant path exiting the heat exchanger 18, as illustrated for a bypass valve 62 and an expansion valve 64.

The expansion valves 60 and 64 would normally function when the corresponding bypass valve 58 or 62 is closed. A possible exception is if a two-phase flow is entering the expansion valve 60 or 64 and the valve does not have sufficient capacity to handle the flow. In this case, the bypass valve can be partially opened to provide extra valve capacity, but the expansion valve is still used for fine control over refrigerant flow. If this mode of operation is required, the motor-actuated ball valve or other valve with the ability to modulate flow is preferred. Use of multiple staged solenoid valves are another alternative to obtain steps of capacity control.

Figure 4:
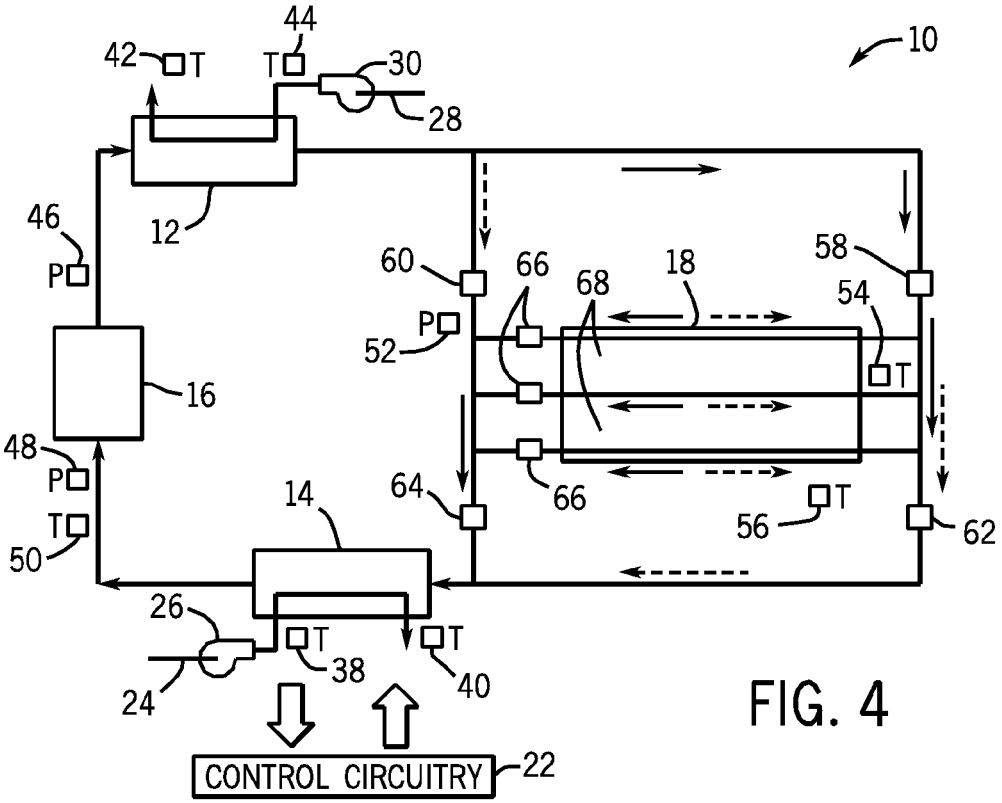
FIG. 4 is a diagrammatical view of another alternative configuration of the inventive system.

FIG. 4 shows another alternative embodiment that reverses refrigerant flow through the ("outdoor") heat exchanger 18. It should be noted that the solid arrows in the figure indicate flow in "condenser mode" (i.e., when heat exchanger 18 is operated as a condenser), while the broken arrows indicate flow in "evaporator mode" (i.e., when heat exchanger 18 is operated as an evaporator). When the heat exchanger 18 operates as an evaporator, refrigerant flows through expansion valve 60, through refrigerant distributors 66, through parallel refrigerant tubes or tube groups 68 in the heat exchanger, and then through bypass valve 62 to the evaporator 14. The distributors act as flow restrictions to ensure good refrigerant distribution in the coil. When the heat exchanger 18 operates as a condenser, valve 60 and bypass valve 62 are closed. Refrigerant flows through bypass valve 58, through the heat exchanger tubes 68 and the distributor 66, and to expansion valve 64, which feeds liquid refrigerant into the evaporator 14. This configuration ensures that liquid refrigerant is always flowing through the flow distributors 66, which allows for improved performance in the evaporator mode without a pressure-drop penalty in the condenser mode.

Figure 5:
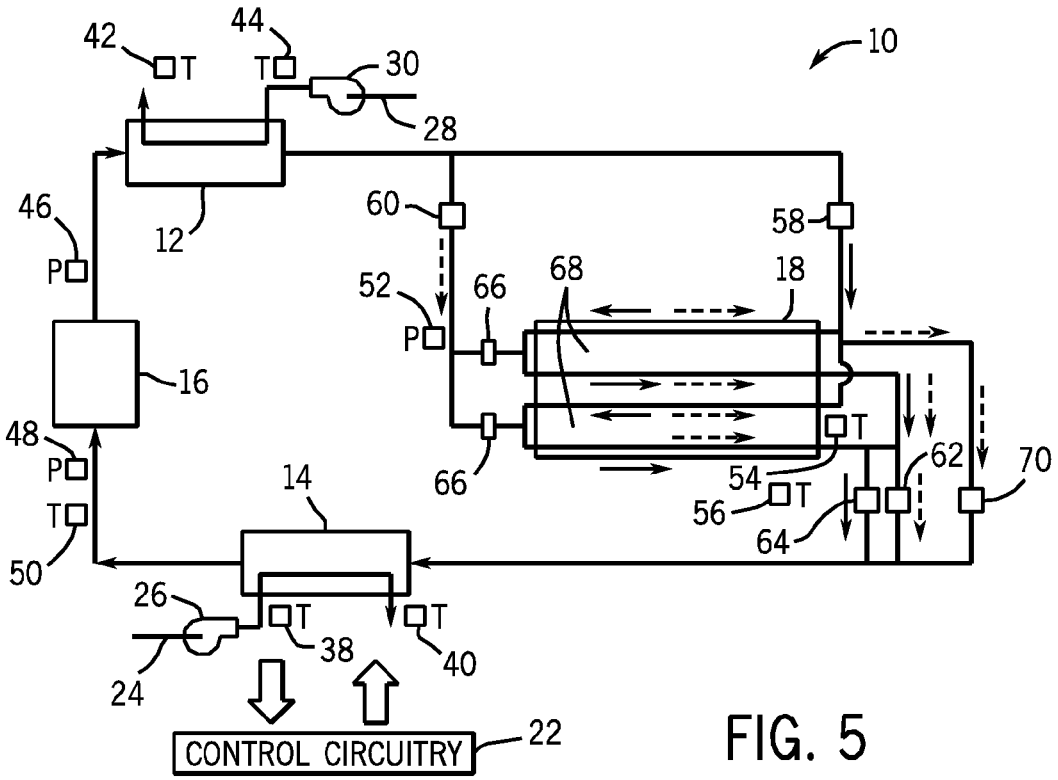
FIG. 5 is a diagrammatical view of a further alternative configuration of the inventive system.

FIG. 5 shows another alternative embodiment in which refrigerant flows through the heat exchanger 18 in series flow in the condenser mode, but in parallel flow in the evaporator mode. In the condenser mode, refrigerant flows through the bypass valve 58, the condenser tubes 68, and then through expansion valve 64. In the evaporator mode, refrigerant flows through expansion valve 60 and the associated distributors 66, to a location about halfway through in the heat exchanger. Approximately half (or an appropriate portion) of the refrigerant flows through the tubes 68 and through bypass valve 62. The other half goes through the tubes 68 in a direction that is opposite of the condenser flow and exits through a further bypass valve 70.

The configuration in FIG. 5 has several advantages:

1. High velocity in condenser mode: In the condenser mode, the refrigerant can flow at a relatively high velocity, which provides good heat transfer.
2. Low pressure drop in evaporator mode: The parallel flow doubles the available flow area and halves the effective length of the flow path, which minimizes pressure drop in the evaporator mode.
3. Common bypass valves: In the evaporator mode, two bypass valves handle the flow, while in the condenser mode, only one valve is required. Since typical condenser refrigerant density is roughly twice the density evaporator conditions, this setup keeps pressure drops at reasonable values using a common valve size. Of course, other setups can use two bypass valves in parallel to limit pressure drop, but they lack the other advantages.

4. Distributors in evaporator mode: The distributors assure good refrigerant distribution in the evaporator mode.
5. Distributors bypassed in condenser mode: Refrigerant flow can bypass the distributors in the condenser mode, which eliminates any pressure drop issue.

There are many different alternatives for the components and details of the configuration. For example, the condenser may be a brazed plate heat exchanger, a shell-and-tube heat exchanger with shell-side condensation, or a shell-and-tube heat exchanger with tube-side condensation. Another alternative is an air-cooled condenser coil, which may be located in ductwork that supplies heated air to the building. In any case, it is desirable to select a condenser with a relatively low refrigerant-side pressure drop to improve performance of the system when the outdoor coil is operating in the condenser mode. For this reason, the preferred liquid-cooled condenser is a shell-and-tube design with shell-side condensation.

If a water-cooled subcooler is used, it is preferably located in the same line as the expansion valve 60 on the upstream side of the valve. This location effectively eliminates pressure drop for refrigerant flowing through the bypass valve 58, while allowing high refrigerant velocity through the subcooler during operation of the expansion valve 60. The preferred type of subcooler is a brazed-plate heat exchanger that receives a portion of the entering condenser water. In the case of a condenser with multiple water passes, the warmed water from the subcooler is preferably returned to flow through the second or later pass of the condenser. Alternatively, the warmed water can join the water leaving the condenser, but preferably sufficiently upstream of temperature sensor 42 to allow for accurate measurement of a mixed water temperature. Subcoolers can improve system efficiency and capacity, although they add cost and complexity, so the inclusion of a subcooler depends on the particular application.

Moreover, while a single condenser appears in FIG. 1, multiple condensers are also an option. If multiple condensers are used, the preferred flow configuration is series flow to prevent undesirable accumulation of refrigerant liquid or oil in condensers with low refrigerant flow. With multiple condensers control of the flow of air or water may be the preferred way to limit heat rejection.

Yet another alternative is to include a desuperheater. The desuperheater is preferably located in the discharge line between the compressor and the condenser. Desuperheaters normally heat a relatively small flow of water, such as for providing domestic hot water, to a high temperature using thermal energy extracted from superheated refrigerant vapor. The preferred designs of the desuperheater are similar to those used in air-cooled chiller applications in the prior art.

Similarly, there are many different alternatives for the evaporator. For simplicity in dealing with oil return, a DX evaporator may be preferred. Other alternatives include a falling film or flooded evaporator. As with the condenser, it may be important to limit pressure drop through the evaporator to prevent excessive performance penalties, especially in the air-to-water heat pump mode. While the preferred configuration cools water or other liquid, it is also possible to cool air or gas directly with a suitable evaporator. Further, as with the condenser, it is possible to use multiple evaporators. A presently contemplated configuration is series refrigerant flow with control over the air or water in the individual heat exchangers.

The design of the "outdoor" heat exchanger 18 should consider both evaporator and condenser operation. In contrast to a reversing heat pump, refrigerant flow is always in the same direction through the condenser 12 and the evaporator 14, which allows counterflow or counter crossflow design for both modes of operation for the coil. A presently contemplated heat exchanger 18 is preferably of conventional round-tube plate-fin design. The fins in the coil should be selected for acceptable condensate drainage. They should also be able to handle frost accumulation without excess problems.

Another consideration is refrigerant management. Ideally operation of the control valves, fans, pumps, etc. should be sufficient to ensure there is adequate refrigerant in each operating heat exchanger without excessive accumulation of refrigerant in any location. However, in certain systems it may be necessary to add liquid receivers or accumulators to keep an optimum amount of refrigerant in circulation for different operating conditions. For example, if there is excess refrigerant in the system when operating with the outdoor coil as a condenser, it may be desirable to put a receiver near the outlet of the outdoor coil. On the other hand, if there is too much refrigerant present in heating modes, it may be desirable to locate a receiver on the outlet of the condenser or optional subcooler. An accumulator on the suction line also may be useful to protect the compressor from excessive amounts of refrigerant liquid in some cases. Selection of receivers and/or accumulators can be important to optimum performance and reliability the system, but do not change the basic functions of the system.

Pressure drop of the refrigerant coils of heat exchanger 18 may be an important consideration. A design goal may be to maintain a low pressure drop for good performance in evaporator mode while maintaining acceptable performance in condenser mode.

Moreover, a liquid-to-refrigerant heat exchanger or direct-contact ground loop may be used instead of an outdoor heat exchanger open to ambient air. In the case of the liquid-to-refrigerant heat exchanger, flow of liquid, such as water or brine, may be adjusted in a similar manner as the air flow for an outdoor coil as described earlier. The liquid can then flow through a ground loop, a dry tower, or a wet cooling tower. In the case of a wet or dry cooling tower, it may be desirable to control tower fan speed or air flow to reduce energy use and to provide better control in different modes of operation. In the case of a direct-contact ground loop, operating modes are somewhat limited because there is no way to control heat transfer on the ground side of the heat exchanger.

There are many other configurations that use the same inventive concepts described herein and contemplated by the invention. For example, it may be desirable to include an electric or gas-fired boiler as a part of the package with the heat pump. Chilled and hot water pumps may also be included to simplify installation.

While the above analysis is for a single refrigerant circuit, much of it applies to heat pumps with multiple refrigerant circuits. In general the modes of operation of each refrigerant circuit are still available, but there may be advantages to run refrigerant circuits in different modes in the same unit.

For example, in the case where a building simultaneously requires a small amount of heating and a large amount of cooling capacity, if there were only one refrigerant circuit, the heat pump should run in mode 3 (water-to-water heat pump with supplemental heat rejection to heat exchanger 18). If there are two refrigerant circuits, it may be desirable to run one refrigerant circuit in mode 4 (water-to-water heat pump with full heat recovery) to handle the full heating requirement. At the same time, the other refrigerant circuit runs in mode 1 (cooling only) to supply the rest of the cooling requirement. The advantage of this approach is that the condensing temperature for mode 1 may be much lower than required for mode 3 or 4, which allows for improved energy efficiency for system overall.

Similarly it may be desirable to run one circuit in mode 6 (heating only) and the other in mode 4 (water-to-water heat pump with full heat recovery) instead of running both circuits in mode 5 (water-to-water heat pump with supplement heat source from the outdoor coil).

Another issue is compressor loading for multiple refrigerant circuits at part-load conditions. For staged scroll compressors, variable-speed screw compressors, or other compressors with efficiency part load operation, it may be desirable to run each circuit at part load rather than running one circuit at a higher load. Testing and analysis is required to develop the optimum control to maximize energy efficiency.

Figure 6:
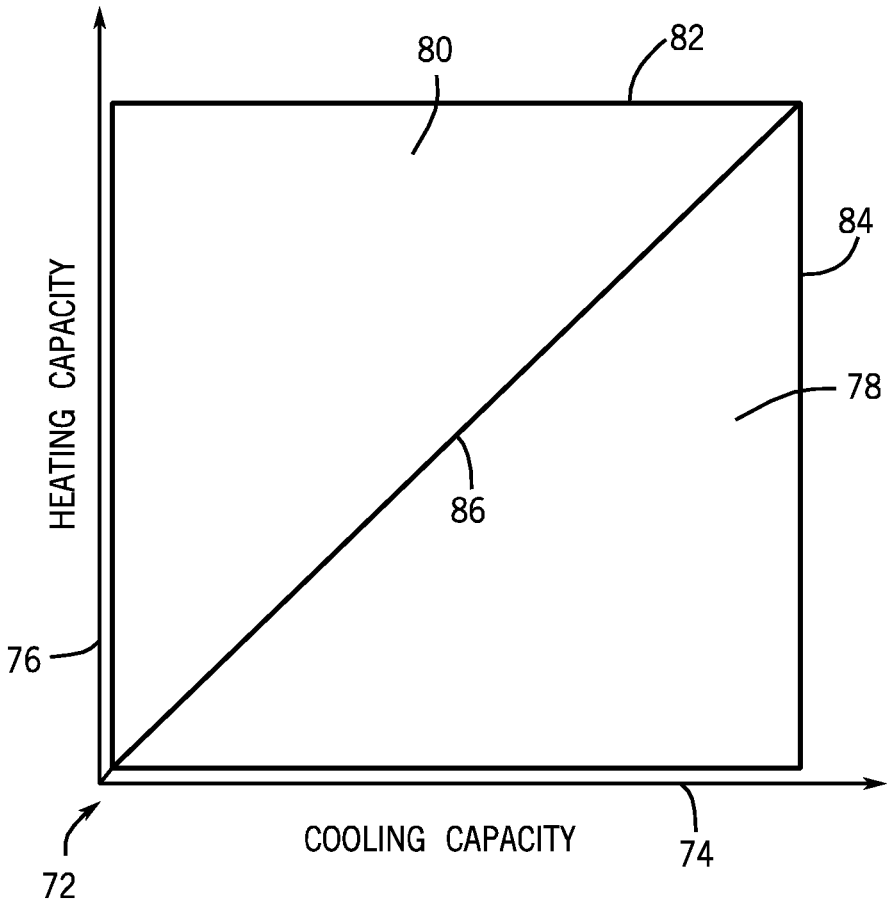
FIG. 6 is a diagrammatical map of certain presently contemplated operating modes for the system.

FIG. 6 shows a mapping 72 of the different operating modes for the invention and illustrates the advantage over conventional systems. The horizontal axis 74 is cooling capacity and the vertical axis 76 is heating capacity. Mode 1 (cooling only) is a line 82 on the horizontal axis, since there is no heating available in this mode. A conventional air-cooled chiller can operate only along this line. In contrast, the proposed invention can operate over full range of conditions as shown by the rectangle. Mode 6 (heating only) is a line 84 on the vertical axis. A reversing air-to-water heat pump can run along this line, in addition to the line for mode 1, but it is unable to provide simultaneous heating and cooling so it is unable to run at other conditions on the map. Mode 4 (water-to-water heat pump with full heat recovery) is a diagonal line 86. A conventional dedicated water-to-water heat pump operates along this line.

Mode 2 (cooling with partial heat recovery) is available to a conventional air-cooled chiller with heat recovery heat exchanger. This type of equipment can provide simultaneous heating and cooling as shown by the triangle 78 in the lower right of the chart, but there are with limitations. Full heat recovery may not be available at all ambient conditions. In addition, the available heated water temperature is limited by the condensing conditions available from the chiller. The current invention combines all the operating modes available from conventional heat pumps and heat recovery equipment, plus additional two additional operating modes to greatly improve the range of operation. Mode 3 allows the invention to provide heated water and cooling simultaneously with a controlled heated water temperature. Mode 5 allows the invention to provide simultaneous heating and cooling, while using the heat exchanger 18 as a supplemental heat source, as indicated by area 80 of the mapping. This analysis clearly shows the improved versatility of the invention, which translates into energy savings.

An additional benefit of the invention is relatively low cost. It is based on conventional air-cooled chillers. The additional water-cooled condenser and control valves are only a small fraction of the total unit cost. Unlike a dedicated water-to-water heat pump, the invention can reject heat to the ambient air without any additional equipment, which reduces the cost of the installation. An added benefit is that in mild climates it may be possible to reduce or eliminate the cost of a boiler for heating since that function is included in the system.

Another advantage is simplicity of installation. The invention effectively provides a heating and cooling plant without the need for a large equipment room, cooling tower, etc. The controls for the heating and cooling functions are integrated into the package, which further reduces the complexity to the customer.

The invention has several advantages related to control valving compared to conventional reversing heat pumps. A reversing heat pump requires a reversing valve, which is normally a four-way valve. Alternatively the reversing valve function can be handled with two three-way valves, or four two-way valves. In any case, this reversing valve must be able handle the full suction flow volume during both heating and cooling modes, which can create a large performance penalty or cost penalty.

In contrast, the proposed invention uses two or three two-way valves, one of which can see only discharge gas volume. In all normal modes of operation, at least one of the valves is closed or used as an expansion valve, which effectively eliminates any performance penalty from refrigerant pressure drop through the valve. For example in cooling mode, only the high-side pressure drop through bypass valve 58 in FIG. 4, or 5 affects performance. In contrast, a reversing heat pump would have an additional penalty associated with a large pressure drop through the four-way valve on the suction side of the compressor. An additional advantage of the invention is the elimination of heat transfer between suction and discharge gas streams, which is sometimes a problem with conventional reversing valves. Thus the invention reduces the flow requirements and performance penalties for the control valving, which provides savings in valve costs and/or improved system performance.

In short the advantages include: highly versatile operation; high energy efficiency; low installed cost; simplicity for customer; and reduced valve costs and pressure losses.

While only certain features and embodiments of the invention have been illustrated and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the invention. Furthermore, in an effort to provide a concise description of the exemplary embodiments, all features of an actual implementation may not have been described (i.e., those unrelated to the presently contemplated best mode of carrying out the invention, or those unrelated to enabling the claimed invention). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A heating and cooling system, comprising:

an evaporator configured to receive a flow of refrigerant and a first fluid stream for heat exchange with the refrigerant, wherein the evaporator is configured to facilitate evaporation of the refrigerant during operation of the evaporator;

a compressor configured to receive the refrigerant from the evaporator and configured to compress the refrigerant during operation of the compressor;

a condenser configured to receive the refrigerant from the compressor and configured to receive a second fluid stream for heat exchange with the refrigerant, wherein the condenser is configured to facilitate condensation of the refrigerant during operation of the condenser;

a heat exchanger configured to receive the refrigerant from the condenser and configured to transfer the refrigerant to the evaporator;

a first control valve between the condenser and the heat exchanger;

a second control valve between the heat exchanger and the evaporator; and control circuitry configured to:

modulate the first control valve to facilitate expansion of the refrigerant while the second control valve is open in a first operational mode of the heat exchanger, and configured to modulate the second control valve to facilitate expansion of the refrigerant while the first control valve is open in a second operational mode of the heat exchanger.

2. The system of claim 1, comprising:

an evaporator pump configured to supply the first fluid stream to the evaporator; and a condenser pump configured to supply the second fluid stream to the condenser.

3. The system of claim 2, wherein the control circuitry is configured to operate in a cooling only mode such that the first control valve is opened, the second control valve is modulated as an expansion valve, a fan of the heat exchanger is controlled based on output from a pressure sensor of the condenser, compressor capacity of the compressor is controlled based on output from a temperature sensor on an output of the first fluid from the evaporator, the evaporator pump is flowing the first fluid to the evaporator, and the condenser pump is not flowing the second fluid to the condenser.

4. The system of claim 2, wherein the control circuitry is configured to operate in a cooling with partial heat recovery mode such that the first control valve is opened, the second control valve is modulated as an expansion valve, a fan of the heat exchanger is controlled based on output from a pressure sensor of the condenser, compressor capacity of the compressor is controlled based on output from a temperature sensor on an output of the first fluid from the evaporator, the evaporator pump is flowing the first fluid to the evaporator, and the condenser pump is flowing the second fluid to the condenser.

5. The system of claim 2, wherein the control circuitry is configured to operate in a water-to-water heat pump with supplemental heat rejection mode such that the first control valve is opened, the second control valve is modulated as an expansion valve, a fan of the heat exchanger is controlled based on output from a temperature sensor on an output of the second fluid from the condenser, compressor capacity of the compressor is controlled based on output from a temperature sensor on an output of the first fluid from the evaporator, the evaporator pump is flowing the first fluid to the evaporator, and the condenser pump is flowing the second fluid to the condenser.

6. The system of claim 2, wherein the control circuitry is configured to operate in a water-to-water heat pump with full heat recovery mode such that the first control valve is modulated to maintain a temperature of the refrigerant in the heat exchanger proximate an ambient air temperature, the second control valve is modulated to maintain a substantially constant superheat of the refrigerant leaving the evaporator, a fan of the heat exchanger is turned off or not controlled, compressor capacity of the compressor is controlled based on output from a temperature sensor on an output of the first fluid from the evaporator, the evaporator pump is flowing the first fluid to the evaporator, and the condenser pump is flowing the second fluid to the condenser.

7. The system of claim 2, wherein the control circuitry is configured to operate in a water-to-water heat pump with supplemental heat source mode such that the first control valve is modulated as an expansion valve, the second control valve is opened, a fan of the heat exchanger is controlled based on output from a temperature sensor measuring ambient temperature or output from a pressure sensor of the evaporator, compressor capacity of the compressor is controlled based on output from a temperature sensor on an output of the second fluid from the condenser, the evaporator pump is flowing the first fluid to the evaporator, and the condenser pump is flowing the second fluid to the condenser.

8. The system of claim 2, wherein the control circuitry is configured to operate in an air-to-water heat pump mode such that the first control valve is modulated as an expansion valve, the second control valve is opened, a fan of the heat exchanger is controlled based on an output from a pressure sensor on the evaporator or a measure of compressor capacity of the compressor, compressor capacity of the compressor is controlled based on output from a temperature sensor on an output of the second fluid from the condenser, the evaporator pump is not flowing the first fluid to the evaporator, and the condenser pump is flowing the second fluid to the condenser.

9. The system of claim 8, wherein the first control valve is controlled based on a suction superheat measure.

10. The system of claim 2, wherein the control circuitry is configured to operate in a defrost mode such that the first control valve is opened, the second control valve is modulated as an expansion valve, a fan of the heat exchanger is turned off or not controlled, the evaporator pump is flowing the first fluid to the evaporator, and the condenser pump is not flowing the second fluid to the condenser.

11. The system of claim 1, wherein the first operational mode comprises operating the heat exchanger in an evaporation mode such that a third fluid transfers heat to the refrigerant in the heat exchanger.

12. The system of claim 1, wherein the second operational mode comprises operating the heat exchanger in a condensation mode such that the refrigerant transfers heat from the refrigerant to a third fluid in the heat exchanger.

13. The system of claim 12, wherein the third fluid comprises air being moved through the heat exchanger by a fan.

14. A heating and cooling system, comprising:

a condenser configured to receive a flow of refrigerant from a compressor and configured to receive a first fluid stream for heat exchange with the refrigerant, wherein the condenser is configured to facilitate condensation of the refrigerant during operation of the condenser;

a heat exchanger configured to receive the refrigerant from the condenser;

an evaporator configured to receive the refrigerant from the heat exchanger and configured to receive a second fluid stream for heat exchange with the refrigerant, wherein the evaporator is configured to facilitate evaporation of the refrigerant during operation of the evaporator;

a first control valve between the condenser and the heat exchanger;

a second control valve between the heat exchanger and the evaporator; and control circuitry configured to modulate the first valve to facilitate expansion of the refrigerant in a first operational mode of the heat exchanger and configured to modulate the second valve to facilitate expansion of the refrigerant in a second operational mode of the heat exchanger.

15. The system of claim 14, comprising the compressor configured to receive the refrigerant from the evaporator and configured to compress the refrigerant during operation of the compressor.

16. The system of claim 14, comprising a first bypass valve arranged in parallel with the first control valve and a second bypass valve arranged in parallel with the second control valve.

17. The system of claim 14, wherein the first control valve is positioned between the condenser and a first entry into the heat exchanger, the second control valve is positioned between the evaporator and a first exit from the heat exchanger, a first bypass valve is positioned between the condenser and a second entry into the heat exchanger, and a second bypass valve is positioned between the evaporator and a second exit from the heat exchanger.

18. The system of claim 17, wherein the control circuitry is configured to:

close the first bypass valve and open the second bypass valve in the first operational mode; and open the first bypass valve and close the second bypass valve in the second operational mode.

19. The system of claim 17, wherein the heat exchanger comprises a coil with refrigerant distributors configured to control refrigerant distribution within the coil.

20. A heating and cooling system, comprising:

a condenser;

a heat exchanger downstream of the condenser, the heat exchanger configured to receive a flow of refrigerant from the condenser;

an evaporator downstream of the heat exchanger, the evaporator configured to receive the refrigerant flow from the heat exchanger;

first control valving positioned downstream of the condenser and upstream of the heat exchanger;

second control valving positioned downstream of the heat exchanger and upstream of the evaporator; and control circuitry configured to operate the first and second control valving to control the refrigerant flow such that the refrigerant flow continues in a direction from the condenser to the evaporator in a cooling mode wherein the heat exchanger provides a condenser function and in a heating mode wherein the heat exchanger provides an evaporator function.

* * * * *